US011083246B2

(12) United States Patent
Lyke et al.

(10) Patent No.: US 11,083,246 B2
(45) Date of Patent: Aug. 10, 2021

(54) FOOTWEAR WITH EMBROIDERY TRANSITION BETWEEN MATERIALS

(71) Applicant: NIKE, Inc., Beaverton, OR (US)

(72) Inventors: Christopher J. Lyke, Portland, OR (US); Lai Wa C. Ho, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/408,909

(22) Filed: May 10, 2019

(65) Prior Publication Data

US 2019/0261740 A1 Aug. 29, 2019

Related U.S. Application Data

(63) Continuation of application No. 15/409,311, filed on Jan. 18, 2017, now Pat. No. 10,321,738.
(Continued)

(51) Int. Cl.

| | |
|---|---|
| ***A43B 23/02*** | (2006.01) |
| ***A43B 1/04*** | (2006.01) |
| ***A43B 23/07*** | (2006.01) |
| ***D05C 17/00*** | (2006.01) |
| ***A43B 3/00*** | (2006.01) |

(52) U.S. Cl.
CPC ..... *A43B 23/0205* (2013.01); *A43B 1/04* (2013.01); *A43B 3/0078* (2013.01); *A43B 23/021* (2013.01); *A43B 23/025* (2013.01); *A43B 23/026* (2013.01); *A43B 23/0245* (2013.01); *A43B 23/0255* (2013.01);
(Continued)

(58) Field of Classification Search
CPC ..... A43B 23/025; A43B 23/0255; A43B 23/0295; A43B 1/04; A43B 23/0205; A43B 23/021; A43B 23/026
See application file for complete search history.

(56) References Cited

U.S. PATENT DOCUMENTS 1,401,466 A 12/1921 De Vod
1,725,749 A 8/1929 Blair
(Continued)

FOREIGN PATENT DOCUMENTS

CN 1067566 1/1993
CN 1925763 3/2007
(Continued)

OTHER PUBLICATIONS

"U.S. Appl. No. 15/409,329, Response filed Jun. 17, 2020 to Non Final Office Action dated Mar. 17, 2020", 15 pgs.
(Continued)

*Primary Examiner* — Ted Kavanaugh
(74) *Attorney, Agent, or Firm* — Schwegman Lundberg & Woessner, P.A.

(57) ABSTRACT

An article of footwear comprises a sole structure and an upper. The upper is connected to the sole structure to form an enclosure to at least partially receive a foot. The upper comprises a first panel forming a first portion of the upper and having a first texture, a second panel forming a second portion of the upper and having a second texture, and an embroidery area extending across portions of the first panel and the second panel and having an appearance that replicates the first texture extending into the second texture.

20 Claims, 9 Drawing Sheets

Related U.S. Application Data

(60) Provisional application No. 62/280,547, filed on Jan. 19, 2016.

(52) U.S. Cl.
CPC ..... *A43B 23/0265* (2013.01); *A43B 23/0295* (2013.01); *A43B 23/07* (2013.01); *D05C 17/00* (2013.01)

(56) References Cited

U.S. PATENT DOCUMENTS

| | | | |
|---|---|---|---|
| 2,158,533 | A | 5/1939 | Cavey |
| 2,235,694 | A | 3/1941 | Wolfhard et al. |
| 2,293,370 | A | 8/1942 | Tweedie |
| 2,563,916 | A | 8/1951 | Brussell |
| 2,881,724 | A | 4/1959 | Cremer et al. |
| 2,896,303 | A | 7/1959 | Morrill |
| 3,364,098 | A | 1/1968 | Patsis |
| 3,441,464 | A | 4/1969 | Blue |
| 3,497,414 | A | 2/1970 | Blue |
| 3,535,187 | A | 10/1970 | Wood |
| 3,562,931 | A | 2/1971 | Karygiannis |
| 3,605,223 | A | 9/1971 | Barth |
| 3,606,654 | A | 9/1971 | Dilo |
| 3,703,752 | A | 11/1972 | Schulte |
| 3,705,064 | A | 12/1972 | Lochner |
| 3,772,746 | A | 11/1973 | Ivanowicz |
| 3,774,273 | A | 11/1973 | Okamoto et al. |
| 3,794,553 | A | 2/1974 | Lochner |
| 3,865,678 | A | 2/1975 | Okamoto et al. |
| 4,007,071 | A | 2/1977 | Addie et al. |
| 4,146,663 | A | 3/1979 | Ikeda et al. |
| 4,211,593 | A | 7/1980 | Lochner |
| 4,353,158 | A | 10/1982 | Henshaw |
| 4,568,010 | A | 2/1986 | Dilo |
| 4,667,611 | A | 5/1987 | Yamamoto et al. |
| 4,683,624 | A | 8/1987 | Dufour |
| 4,783,909 | A | 11/1988 | Van Doren et al. |
| 4,794,874 | A | 1/1989 | Slattery |
| 4,798,760 | A | 1/1989 | Diaz-Kotti |
| 4,891,870 | A | 1/1990 | Muller |
| 4,917,032 | A | 4/1990 | Matsumoto |
| 4,935,295 | A | 6/1990 | Serafini |
| 5,003,674 | A | 4/1991 | Cohen et al. |
| 5,150,536 | A | 9/1992 | Strong |
| 5,350,255 | A | 9/1994 | Carriker |
| 5,507,900 | A | 4/1996 | Mohammed et al. |
| 5,537,939 | A | 7/1996 | Horton |
| 5,694,872 | A | 12/1997 | Zeller |
| 5,718,180 | A | 2/1998 | Stutznaecker |
| 5,802,739 | A | 9/1998 | Potter et al. |
| 5,909,883 | A | 6/1999 | Jourde et al. |
| 6,048,810 | A | 4/2000 | Baychar |
| 6,170,414 | B1 | 1/2001 | Kaetterhenry et al. |
| 6,237,174 | B1 | 5/2001 | Hutchinson |
| 6,402,879 | B1 | 6/2002 | Tawney et al. |
| 6,446,360 | B1 | 9/2002 | Sheets et al. |
| 6,743,519 | B2 | 6/2004 | Widdemer |
| 7,246,418 | B2 | 7/2007 | Falk et al. |
| 7,347,011 | B2 | 3/2008 | Dua et al. |
| 7,966,956 | B2 | 6/2011 | Susuki et al. |
| 8,429,835 | B2 | 4/2013 | Dojan et al. |
| 8,544,191 | B2 | 10/2013 | Marvin et al. |
| 8,731,696 | B2 | 5/2014 | Jones et al. |
| 8,739,716 | B2 | 6/2014 | Price et al. |
| 8,764,931 | B2 | 7/2014 | Turner |
| 9,044,063 | B2 | 6/2015 | Loverin et al. |
| 9,185,947 | B2 | 11/2015 | Spencer et al. |
| 9,273,423 | B2 | 3/2016 | Chen |
| 10,151,056 | B2 | 12/2018 | Yamazaki |
| 10,321,738 | B2 * | 6/2019 | Lyke ..... A43B 23/021 |
| 2002/0032955 | A1 | 3/2002 | Rasnick et al. |
| 2002/0071946 | A1 | 6/2002 | Norton et al. |
| 2002/0124324 | A1 | 9/2002 | Widdemer |
| 2002/0172792 | A1 | 11/2002 | Jarvis et al. |
| 2002/0172795 | A1 | 11/2002 | Gardner et al. |
| 2004/0109960 | A1 | 6/2004 | Rydin |
| 2004/0191470 | A1 | 9/2004 | Zafiroglu et al. |
| 2006/0059715 | A1 | 3/2006 | Aveni |
| 2006/0218693 | A1 | 10/2006 | Sinohui, Jr. |
| 2007/0271823 | A1 | 11/2007 | Meschter |
| 2008/0010867 | A1 | 1/2008 | Davis, III |
| 2008/0131648 | A1 | 6/2008 | Baychar |
| 2009/0214822 | A1 | 8/2009 | Crook et al. |
| 2009/0246238 | A1 | 10/2009 | Gorman et al. |
| 2009/0280710 | A1 | 11/2009 | Zafiroglu |
| 2010/0077634 | A1 | 4/2010 | Bell |
| 2011/0174204 | A1 | 7/2011 | Berwanger et al. |
| 2012/0144698 | A1 | 6/2012 | Mcdowell |
| 2012/0244310 | A1 | 9/2012 | Visscher |
| 2012/0255201 | A1 | 10/2012 | Little |
| 2013/0004702 | A1 | 1/2013 | Schafer et al. |
| 2013/0255103 | A1 | 10/2013 | Dua et al. |
| 2013/0312284 | A1 | 11/2013 | Berend et al. |
| 2014/0261121 | A1 | 9/2014 | Woodall et al. |
| 2014/0283720 | A1 | 9/2014 | Kawaguchi et al. |
| 2015/0007451 | A1 | 1/2015 | Bruce |
| 2015/0101133 | A1 | 4/2015 | Manz et al. |
| 2015/0157084 | A1 | 6/2015 | Bell et al. |
| 2016/0069006 | A1 | 3/2016 | Dilo |
| 2016/0135543 | A1 | 5/2016 | Anceresi et al. |
| 2016/0194795 | A1 | 7/2016 | Pryne |
| 2017/0202307 | A1 | 7/2017 | Lyke et al. |
| 2017/0202308 | A1 | 7/2017 | Schaefer et al. |
| 2017/0347745 | A1 | 12/2017 | Figur et al. |
| 2018/0103724 | A1 | 4/2018 | Ho |

FOREIGN PATENT DOCUMENTS

| | | | |
|---|---|---|---|
| CN | 101125044 | | 2/2008 |
| CN | 101677649 | | 3/2010 |
| CN | 102713042 | | 10/2012 |
| CN | 104334043 | | 2/2015 |
| CN | 105050442 | | 11/2015 |
| CN | 108697190 | A | 10/2018 |
| CN | 110177478 | | 8/2019 |
| EP | 1266584 | A1 | 12/2002 |
| EP | 2792261 | A1 | 10/2014 |
| EP | 2818070 | A1 | 12/2014 |
| FR | 463287 | A | 2/1914 |
| FR | 3007317 | A1 | 12/2014 |
| FR | 3031015 | A1 | 7/2016 |
| JP | 5945050 | B1 | 7/2016 |
| TW | M520827 | | 5/2016 |
| TW | 201735814 | A | 10/2017 |
| TW | 201735818 | A | 10/2017 |
| WO | WO-2013126475 | A1 | 8/2013 |
| WO | WO-2014182651 | A1 | 11/2014 |
| WO | WO-2017127441 | A1 | 7/2017 |
| WO | WO-2017127449 | A1 | 7/2017 |
| WO | WO-2018075429 | A1 | 4/2018 |

OTHER PUBLICATIONS

"European Application Serial No. 17702251.4, Communication Pursuant to Article 94(3) EPC dated Jul. 23, 2020", 8 pgs.

"U.S. Appl. No. 15/409,329, Restriction Requirement dated Aug. 20, 2019", 6 pgs.

"U.S. Appl. No. 15/409,329, Response filed Dec. 6, 2019 to Restriction Requirement dated Aug. 20, 2019", 7 pgs.

"U.S. Appl. No. 15/409,329, Non Final Office Action dated Mar. 17, 2020", 36 pgs.

"Abutt", Dictionary.com, [Online] Retrieved from the internet:https: www.dictionary.com browse abut, 1 pg.

"Chinese Application Serial No. 201780012654.8, Office Action dated Apr. 24, 2020", w English translation, 18 pgs.

"Taiwanese Application Serial No. 106101969, Office Action dated May 11, 2020", 20 pgs.

"AMS-221 En / IP-420 Instruction Manual. No. 02. 40135402", SanDisk Corporation, (Oct. 2016), 122 pgs.

(56) References Cited

OTHER PUBLICATIONS

"U.S. Appl. No. 15/409,311, Non Final Office Action dated Oct. 9, 2018", 13 pgs.
"U.S. Appl. No. 15/409,311, Notice of Allowance dated Feb. 6, 2019", 7 pgs.
"U.S. Appl. No. 15/409,311, Response filed Jan. 9, 2019 to Non Final Office Action dated Oct. 8, 2018", 11 pgs.
"U.S. Appl. No. 15/409,311, Response filed Sep. 17, 2018 to Restriction Requirement dated Jul. 23, 2018", 7 pgs.
"U.S. Appl. No. 15/409,311, Restriction Requirement dated Jul. 23, 2018", 4 pgs.
"U.S. Appl. No. 15/409,329, Response filed May 3, 2019 to Restriction Requirement dated Feb. 6, 2019", 8 pgs.
"U.S. Appl. No. 15/409,329, Restriction Requirement dated Feb. 6, 2019", 6 pgs.
"U.S. Appl. No. 15/589,641, Non Final Office Action dated Feb. 25, 2019", 17 pgs.
"U.S. Appl. No. 15/589,641, Response filed Dec. 4, 2018 to Restriction Requirement dated Sep. 27, 2018", 8 pgs.
"U.S. Appl. No. 15/589,641, Restriction Requirement dated Sep. 27, 2018", 7 pgs.
"European Application Serial No. 17702251.4, Response filed Mar. 11, 2019 to Communication Pursuant to Rules 161 and 162 dated Aug. 31, 2018", 27 pgs.
"European Application Serial No. 17702253.0, Response filed Mar. 11, 2019 to Communication Pursuant to Rules 161 and 162 dated Aug. 30, 2018", 18 pgs.
"International Application Serial No. PCT/US2017/013964, International Preliminary Report on Patentability dated Aug. 2, 2018", 10 pgs.
"International Application Serial No. PCT/US2017/013964, International Search Report dated Apr. 5, 2017", 5 pgs.
"International Application Serial No. PCT/US2017/013964, Written Opinion dated Apr. 5, 2017", 8 pgs.
"International Application Serial No. PCT/US2017/013975, International Preliminary Report on Patentability dated Aug. 2, 2018", 8 pgs.
"International Application Serial No. PCT/US2017/013975, International Search Report dated Apr. 19, 2017", 4 pgs.
"International Application Serial No. PCT/US2017/013975, Written Opinion dated Apr. 19, 2017", 6 pgs.
"International Application Serial No. PCT/US2017/056851, International Preliminary Report on Patentability dated May 2, 2019", 12 pgs.
"International Application Serial No. PCT/US2017/056851, International Search Report dated Feb. 7, 2018", 3 pgs.
"International Application Serial No. PCT/US2017/056851, Written Opinion dated Feb. 7, 2018", 10 pgs.
"Chinese Application Serial No. 201780012654.8, Response filed Sep. 9, 2020 to Office Action dated Apr. 24, 2020", w current English claims, claims not amended in response filed, 11 pgs.
"U.S. Appl. No. 15/409,329, Final Office Action dated Sep. 30, 2020", 39 pgs.
"Chinese Application Serial No. 2017800143810, Office Action dated Sep. 29, 2020", w English Translation, 30 pgs.
"Chinese Application Serial No. 201780012654.8, Office Action dated Oct. 21, 2020", w English Translation, 8 pgs.
"Taiwanese Application Serial No. 106101969, Response filed Nov. 13, 2020 to Office Action dated May 11, 2020", w English claims, I am not sure if it's needed, but the agent included the full application in english and I didn't know which parts were amended so I kept it all in the PDF, 30 pgs.
"European Application Serial No. 17702251.4, Response filed Nov. 26, 2020 to Communication Pursuant to Article 94(3) EPC dated Jul. 23, 2020", 35 pgs.
"U.S. Appl. No. 15/409,329, Response filed Feb. 26, 2021 to Final Office Action dated Sep. 30, 2020", 14 pgs.
"Chinese Application Serial No. 201780012654.8, Response filed Mar. 4, 2021 to Office Action dated Oct. 21, 2020", w English claims, 21 pgs.
"U.S. Appl. No. 15/409,329, Non Final Office Action dated Mar. 16, 2021", 51 pgs.
"European Application Serial No. 17702251.4, Communication Pursuant to Article 94(3) EPC dated Feb. 22, 2021", 8 pgs.
"Chinese Application Serial No. 201780012654.8, Office Action dated Mar. 17, 2021", w English translation, 7 pgs.

* cited by examiner

FOOTWEAR WITH EMBROIDERY TRANSITION BETWEEN MATERIALS

CLAIM OF PRIORITY

This application is a continuation application of U.S. patent application Ser. No. 15/409,311, filed Jan. 18, 2017, which application claims the benefit of priority of U.S. Provisional Patent Application Ser. No. 62/280,547, filed on Jan. 19, 2016, the contents of both which are incorporated herein by reference in their entireties.

CROSS-REFERENCE TO RELATED PATENT DOCUMENTS

This patent application is also related to Application No. 62/280,554, filed on Jan. 19, 2016.

BACKGROUND

The present disclosure relates to seams or joints for connecting pieces of material that can be used in apparel, footwear and the like. In an exemplary application, the present disclosure relates to the construction of uppers for shoes. Shoe uppers are typically fabricated from a plurality of different materials in order to provide different performance characteristics at different locations on the shoe. For example, it might be desirable for the shoe to be breathable near the toes to allow escape of perspiration, but more rigid at the heel to keep the shoe attached to the foot during use. Thus, a shoe might incorporate a fabric mesh panel near the toe cap and a reinforced polymer panel near the heel cap. Other materials used in footwear may be relatively flexible and tough such as those used near the metatarsophalangeal (MTP) joint between the metatarsal bones of the foot and the proximal phalanges of the toes where repeated bending occurs. Thus, a shoe might incorporate a panel made of leather, vinyl or the like at the vamp.

In order to accommodate the different sizes, shapes and materials used in the panels of shoe uppers, a variety of seaming and joining methods are typically used. Lap joints and butt joints have conventionally been used, as is described in U.S. Pat. No. 2,235,694 to Wolfhard et al. More recently, footwear has incorporated smooth seams, such as those using thermoplastic seam tape as is described in U.S. Pat. No. 8,544,191 to Marvin et al., or seamless joints, such as those using a knitting process including forming an upper by interconnecting a series of stitches or loops as is described in U.S. Pub. No. 2012/0255201 to Little. Additionally, other uppers have been made from a unitary textile material having different stitching or weaving portions to induce different performance characteristics or different aesthetic qualities at different portions of the upper, as is described in U.S. Pat. No. 7,347,011 to Dua et al.

U.S. Pat. No. 5,537,939 to Horton describes an edge embroidery process. U.S. Pat. Application Pub. No. 2015/0157084 to Bell et al. describes generally that embroidery stitches can be used in footwear. U.S. Pat. No. 6,237,174 to Hutchinson describes embroidery on a slipper.

OVERVIEW

The present inventors have recognized, among other things, that a problem to be solved can include panels in footwear uppers that are joined at seams that are uncomfortable on the inside of the footwear and not aesthetically pleasing on the outside of the footwear. The present subject matter can help provide a solution to this problem, such as by joining panels using an embroidery stitch pattern that is flatter and less abrupt than conventional joints. For example, embroidery stitch patterns can be more comfortable owing, for instance, to a flatter seam than a traditional lap joint. As another example, embroidery stitch patterns can be more aesthetic owing, for instance, to a less abrupt seam than a traditional butt joint. In particular, the embroidery described herein can provide a joint that appears to seamlessly blend upper panels of different materials, colors and textures into each other.

In an example, an article of footwear comprises a sole structure and an upper. The upper is connected to the sole structure to form an enclosure to at least partially receive a foot. The upper comprises a first panel forming a first portion of the upper and having a first texture, a second panel forming a second portion of the upper and having a second texture, and an embroidery area extending across portions of the first panel and the second panel and having an appearance that replicates the first texture extending into the second texture.

In an example, the embroidery area has an irregular edge along the second panel and a uniform edge along the first panel and the embroidery area simulates a bleeding of the first panel into the second panel. In another example, the first panel includes a matrix of features disposed on a surface of the first panel and the embroidery replicates those features on the second panel, wherein the embroidery includes a first pattern replicating the surface and a second pattern replicating the matrix of features.

This overview is intended to provide an overview of subject matter of the present patent application. It is not intended to provide an exclusive or exhaustive explanation of the invention. The detailed description is included to provide further information about the present patent application.

Figure 1A:
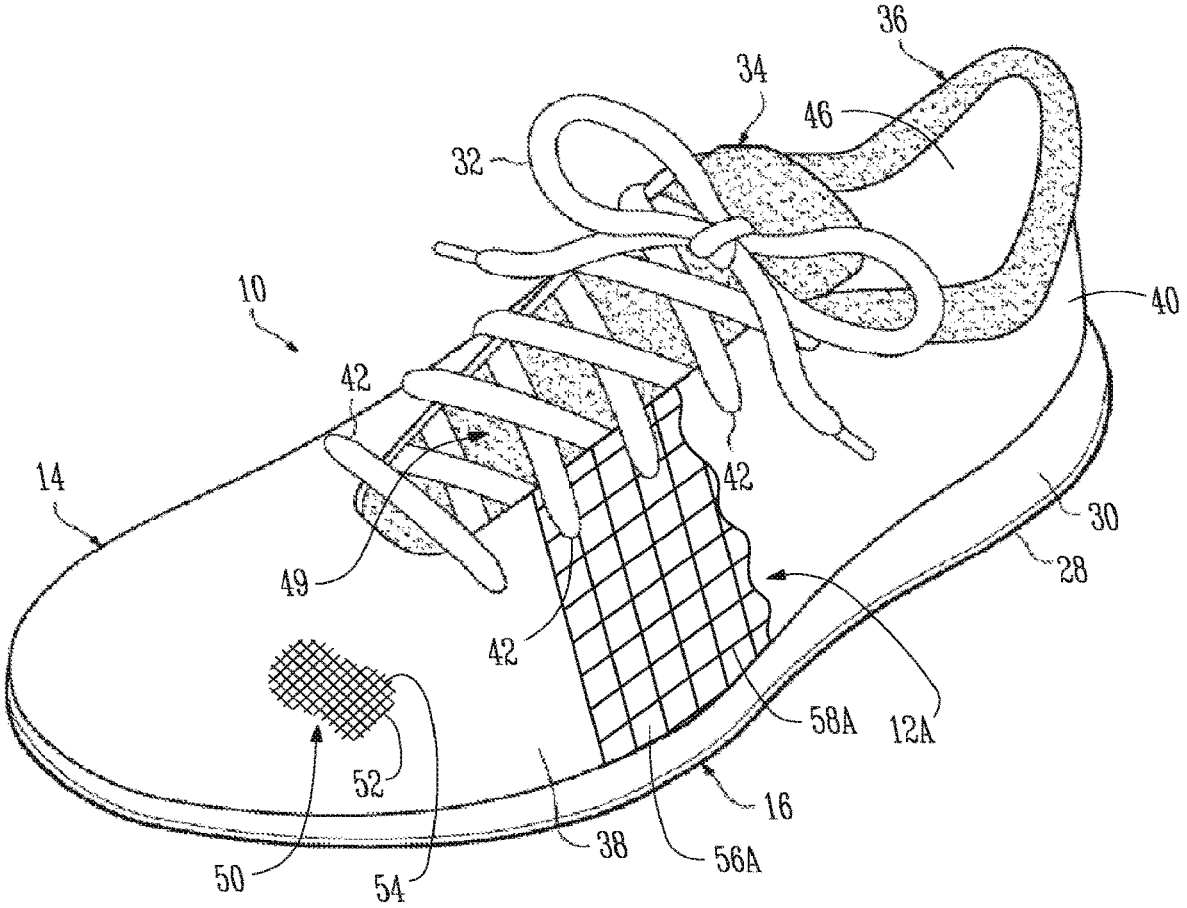
FIG. 1A is a perspective view of a lateral side of an article of footwear having an upper with two panels joined by an embroidery stitch of the present disclosure.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1B:
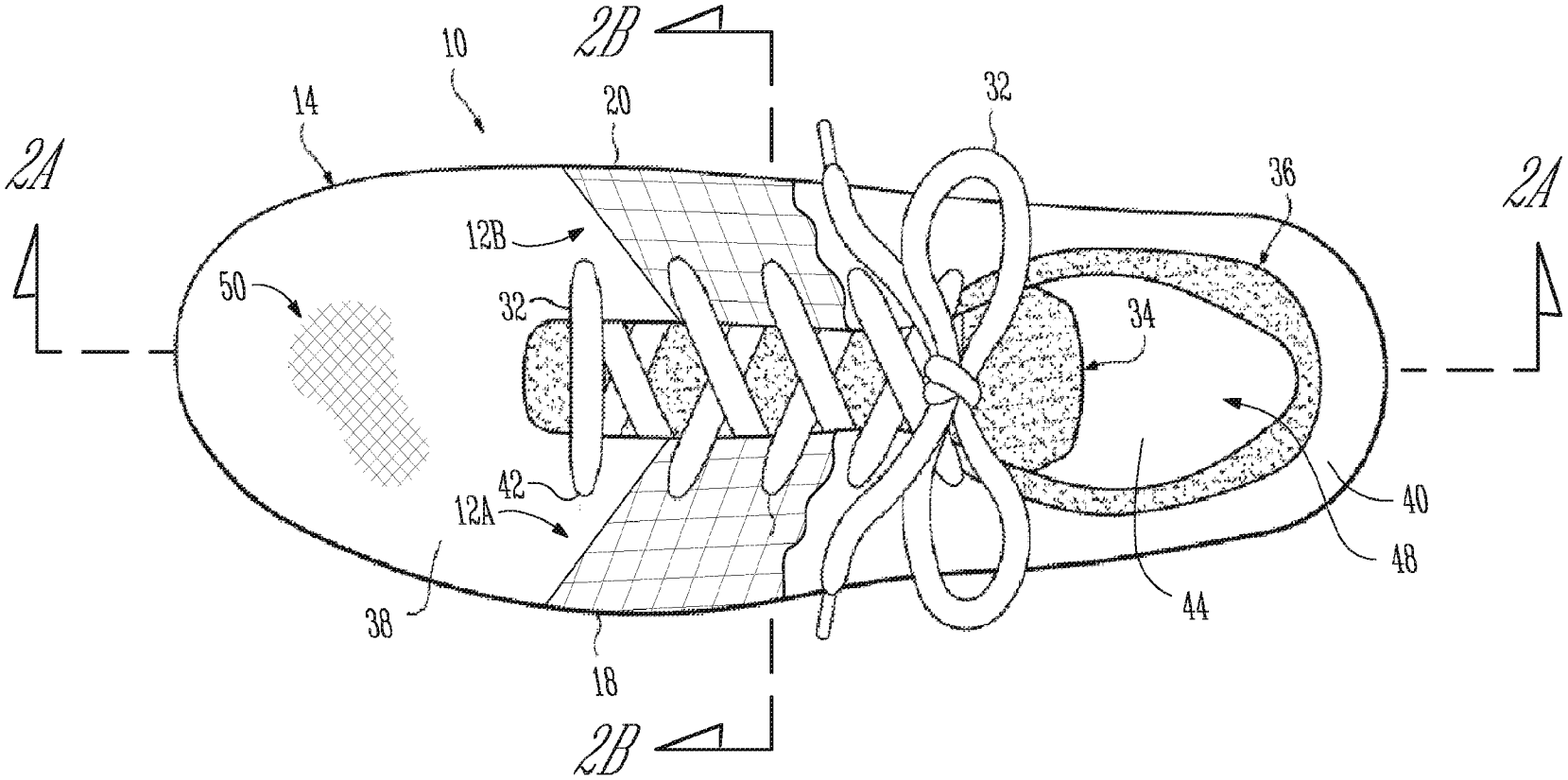
FIG. 1B is a top view of the article of footwear of FIG. 1A showing medial and lateral sides of the upper each having an embroidery transition pattern produced by an embroidery stitch.
Figure 1C:
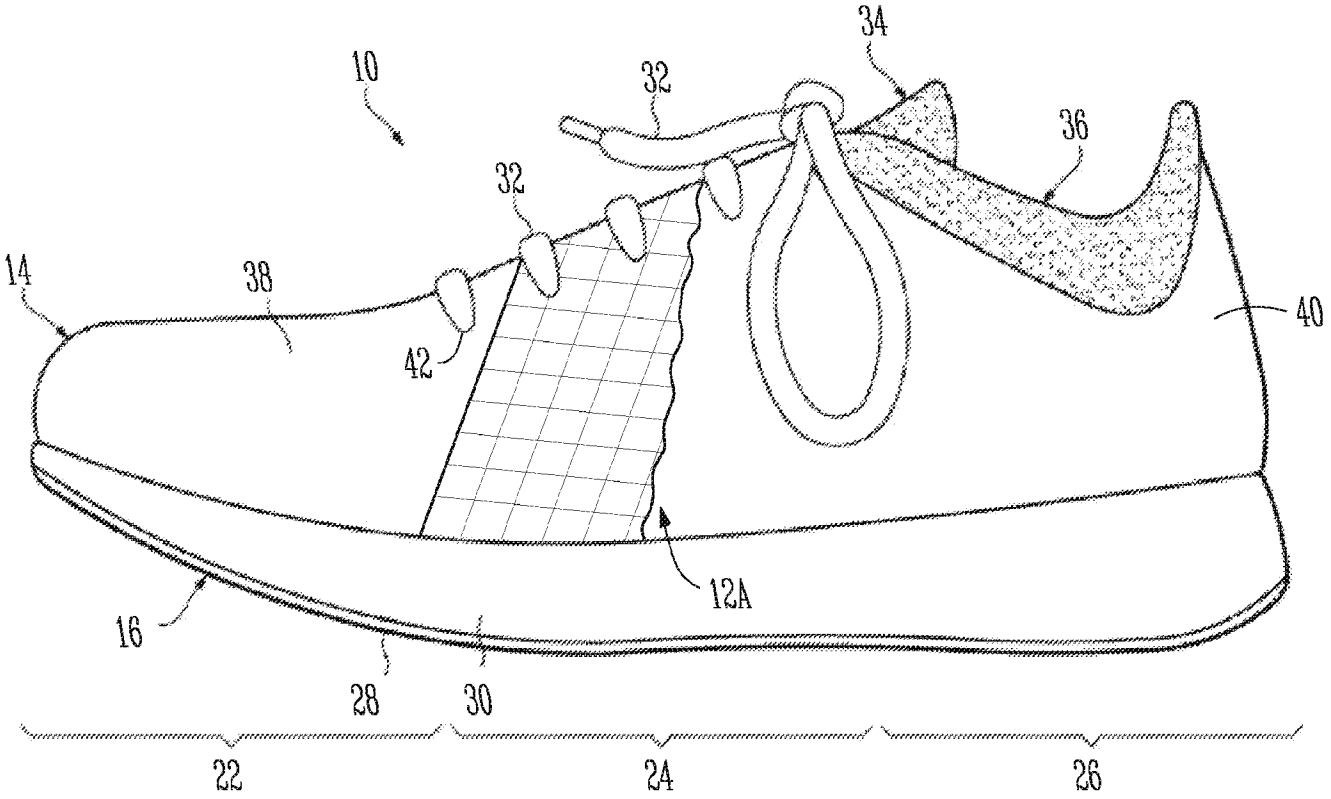
FIG. 1C is a lateral side view of the article of footwear of FIG. 1A illustrating different regions of the article of footwear.

FIG. 1A is a perspective view of article of footwear 10 having embroidery area 12A on upper 14, which is connected to sole structure 16. FIG. 1B is a top view of article of footwear 10, showing lateral side 18 and medial side 20 having embroidery areas 12A and 12B, respectively. FIG. 1C shows lateral side 18 of article of footwear 10 illustrating forefoot region 22, midfoot region 24, and heel region 26. Sole structure 16 can include outsole 28 and midsole 30. Upper 14 can include lace 32, tongue 34 and collar element 36. Upper 14 can be comprised of a plurality of panels of different or the same material, such as toe panel 38 and heel panel 40. Various panels of upper 14 can be connected to each other via embroidery area 12A.

In the example shown, upper 14 includes toe panel 38 and heel panel 40 that at least partially surround a foot. Each of toe panel 38 and heel panel 40 can wrap, at least partially, around medial and lateral sides of upper 14. For example, toe panel 38 can faun a vamp for footwear 10, extending from the lateral MTP joint area of the foot, around the toe cap of footwear 10, and to the medial MTP joint area of the foot. Likewise, heel panel 40 can form a heel counter for footwear 10, extending from the lateral midfoot area of the foot, around the heel cap of footwear 10, and to the medial midfoot area of the foot. Collectively, panels 38 and 40, along with other parts of footwear 10, form a housing when joined to sole structure 16 for at least partially enclosing the foot. Upper 14 can include apertures 42, insole 44, lining 46 and foot space 48. Components of upper 14, including tongue 34, collar element 36, toe panel 38 and heel panel 40, may be formed of various materials, such as knitted, woven, natural or synthetic materials. In the example of FIG. 1A, toe panel 38 is fabricated from a textile having a texture 50, and heel panel 40 is smooth relative to texture 50. For example, texture 50 can have low portions 52 and high portions 54. Toe panel 38 and heel panel 40 can be comprised of one or more sub-panels. Each panel 38 and 40 and sub-panel of footwear 10 can be joined together using conventional stitching and seaming structures and methods. Additionally, as described herein, various panels and sub-panels can be joined using embroidery stitching that results in a pattern that can visually and structurally link the panels together.

Embroidery area 12A extends across ends or edges of toe panel 38 and heel panel 40 and forms a junction therebetween to mechanically interlock panels 38 and 40, thereby reducing or eliminating the need for separate stitching that directly links panel 38 and panel 40. Additionally, embroidery area 12A can be shaped to provide aesthetic aspects to footwear 10. In particular, embroidery area 12A can have a pattern to provide a transition between the colors, textures and materials, and combinations thereof, of panels 38 and 40. Embroidery area 12A can have a plurality of appearances or patterns made from a plurality of different threads to match the appearance, color and shape of texture 50. For example, embroidery area. 12A can include thread 56A and 58A.

Forefoot region 22 generally includes portions of footwear 10 corresponding with the toes and the joints connecting the metatarsals with the phalanges (the MTP joints). Midfoot region 24 generally includes portions of footwear 10 corresponding with the arch area of the foot. Heel region 26 generally corresponds with the heel area of the foot, including the calcaneus hone. Lateral side 18 and medial side 20 extend through each of regions 22-26 in an anterior-posterior direction. Regions 22-26 and sides 18 and 20 are not intended to demarcate precise areas of footwear 10. Rather, regions 22-26 and sides 18 and 20 are intended to represent general areas of footwear 10 to aid in the discussion of footwear 10.

Embroidery of the present disclosure, such as embroidery areas 12A and 12B, can be located in various places and in various orientations in each of the regions and sides of footwear 10. It can, however, be desirable to position embroidery away from high stress points of footwear 10. For example, it can be desirable to position embroidery away from the MTP joint to avoid stressing the embroidery threads due to the repeated bending of the foot. In the example described herein, embroidery area 12A is located along the tarsals, posterior of the MTP joint, and embroidery area 12B is located along the instep of the foot, posterior of the MTP joint. Embroidery can additionally or alternatively be located on the distal superior surface of toe panel 38, on the posterior surface of heel panel 40, on tongue 34 and other locations throughout footwear 10.

Tongue 34 can be connected to toe panel 38 and can extend under lace 32 to enhance the comfort and adjustability of footwear 10. Tongue 34 can extend between opposing portions of toe panel 38 and opposing portions of heel panel 40. Opposing portions of heel panel 40 can be fitted with collar element 36. Collar element 36 is located in at least heel region 26. Collar element 36 and tongue 34 form an opening for providing an access point for a foot into the interior of upper 14. Lace 32 extends through various lace apertures 42 and across throat area 49 of upper 14 to permit a wearer of footwear 10 to modify dimensions of upper 14 and accommodate the proportions of the foot. Lace 32 can operate in a generally conventional manner to tighten upper 14 around the foot when lace 32 is cinched, thereby shrinking the size of foot space 48 of the housing formed by panels 38 and 40. When lace 32 is loosened, upper 14 is also loosened to enlarge the size of foot space 48 of the housing. Footwear 10 can alternatively be provided with other types of fastening systems, such as elastic, hook and loop fastener and similar systems.

A foot of a wearer of footwear 10 can rest on insole 44 within sole structure 16, while upper 14 surrounds the foot to maintain the foot inserted into footwear 10. Sole structure 16 is secured to upper 14 and extends between the foot and the ground when footwear 10 is worn. Midsole 30 is secured to lower portions of upper 14 and can be secured to upper 14 by adhesive, stitching or other suitable means.

Suitable materials for midsole 30 include polymer foam materials such as ethylvinylacetate or polyurethane, or any other material that compresses resiliently so as to attenuate ground reaction forces (i.e., provide cushioning) when compressed between the foot and the ground during walking, running, or other ambulatory or athletic activities associated with a human gait or movement of the foot.

Insole 44 (FIG. 1B) can typically comprises a removable insert disposed atop midsole 30, and can provide additional cushioning or ventilation (e.g. by including perforations). Insole 44 can be located within upper 14 and is positioned to extend under a lower surface of the foot.

Outsole 28 is secured to a lower surface of midsole 30 and may be formed from a wear-resistant rubber material that is textured to impart traction. Outsole 28 can be attached to the lower surface of midsole 30 by adhesive or other suitable means. Suitable materials for outsole 28 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 28 and midsole 30 can also be used as are known in the art. Outsole 28 can include various features for providing traction, such as lugs and ribs.

Midsole 30 may incorporate fluid-filled chambers, plates, moderators, or other elements that further attenuate forces, enhance stability, or influence motions of the foot, or midsole 30 may be primarily formed from a fluid-filled chamber. An air bladder can comprise two plies of polymeric membrane, as is described in U.S. Pat. No. 5,802,739 to Potter et al. In another example, a four-ply air bladder can be used, as is described in U.S. Pat. No. 6,402,879 to Tawney et al. In yet another example, a fabric cushioning element can be used, as is described in U.S. Pat. No. 8,764,931 to Turner. The entire contents of U.S. Pat. Nos. 5,802,739; 6,402,879; and 8,764,931 are hereby incorporated in their entirety by this reference for all purposes. In yet other examples, a bladder may be filled with other gases, such as nitrogen, helium or so-called dense gases such as sulfur hexafluoride, a liquid, or gel.

Upper 14 and sole structure 16 can be configured to enhance the comfort, appearance and performance of footwear during a variety of activities. Although the present description is written with reference to a general purpose athletic shoe, the disclosure of the present application can be applied equally to other types of footwear, such as, but not limited to, dress shoes, running shoes, leisure shoes, fashion shoes, golf shoes, football cleats, soccer shoes, baseball cleats, tennis shoes, sandals, boots, slippers and the like. Additionally, the disclosure of the present application may be used in other articles of manufacture including textiles, articles of apparel and articles of clothing.

Figure 2A:
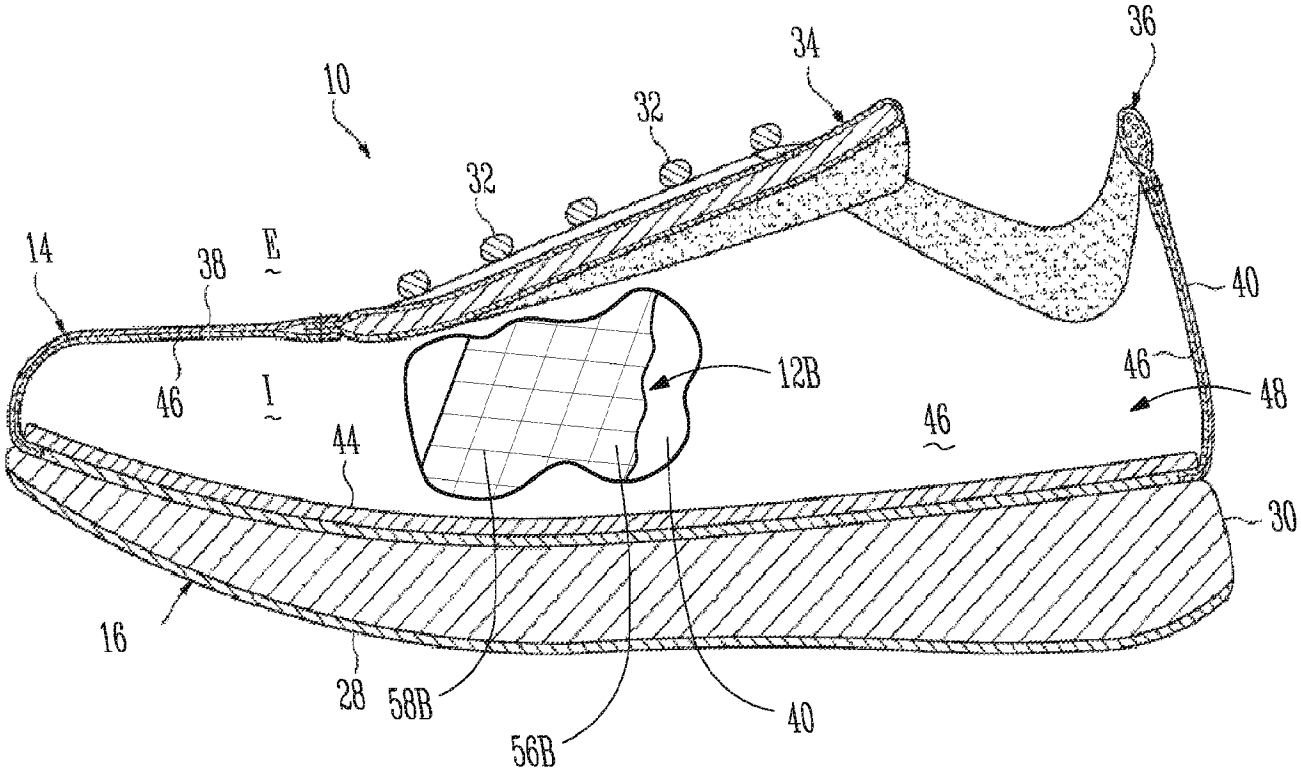
FIG. 2A is a cross-sectional view of the article of footwear of FIG. 1B taken along a toe-to-heel cut to show an internal foot space.
Figure 2B:
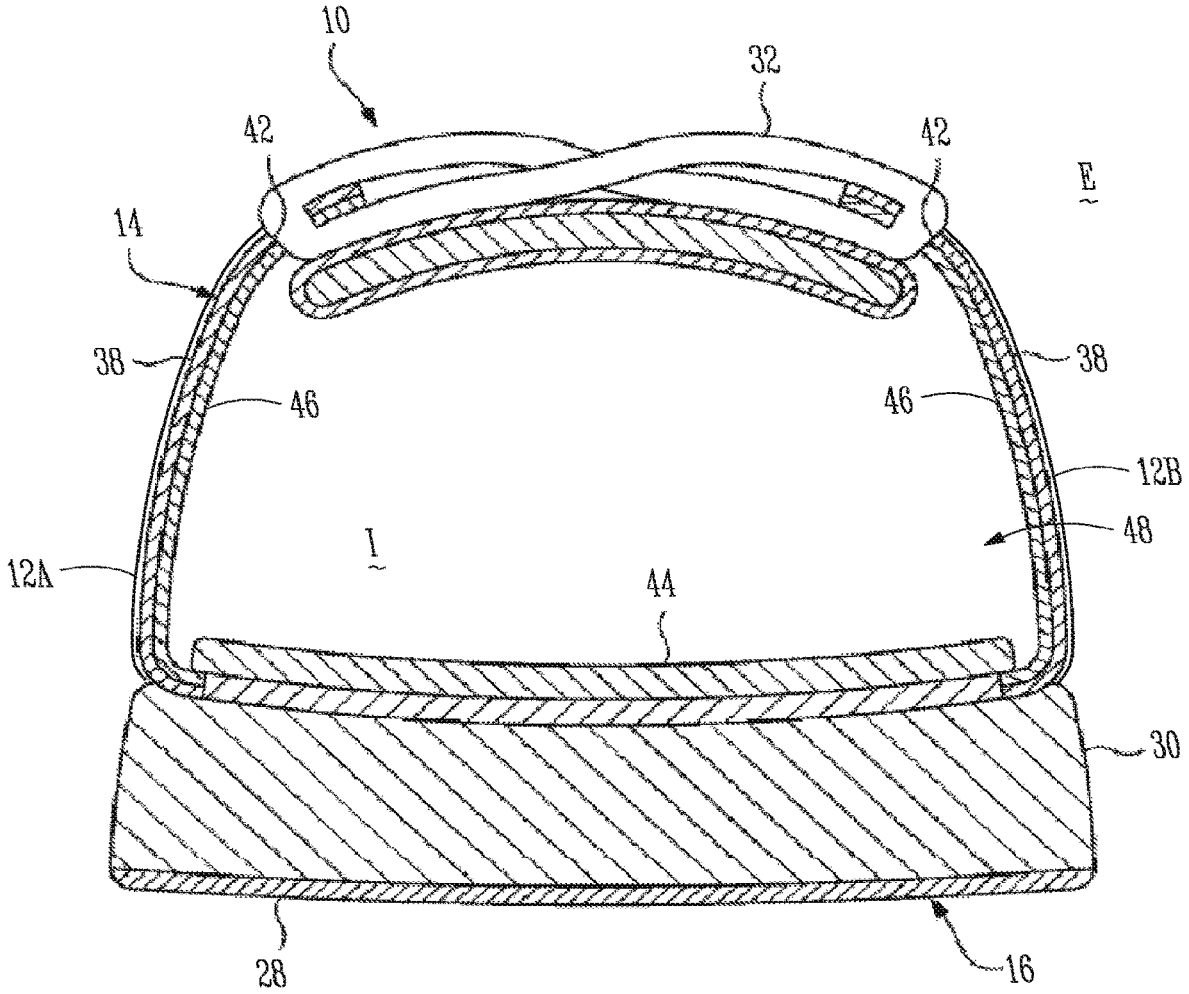
FIG. 2B is a cross-sectional view of the article of footwear of FIG. 1B taken along a medial-lateral cut to show an insole and a lining layer.

FIG. 2A is a cross-sectional view of article of footwear 10 of FIG. 1B taken along a toe-to-heel cut to show an internal foot space 48. FIG. 2B is a cross-sectional view of article of footwear 10 of FIG. 1B taken along a medial-lateral cut to show insole 44 and lining layer 46. A portion of lining layer 46 is broken away in FIG. 2A to show embroidery area 12B on an interior side of toe panel 38 and heel panel 40.

Upper 14 is formed from various layers including those formed by toe panel 38 and heel panel 40 that combine to provide a structure for securely and comfortably receiving a foot. Although the configuration of upper 14 may vary significantly, the various elements generally define a void within footwear 10 for receiving and securing the foot relative to sole structure 16 within foot space 48. Additionally, upper 14 can include internal layers, such as lining layer 46. Panels 38 and 40 form at least a portion of an exterior surface of upper 14. Lining layer 46 forms at least a portion of an interior surface of upper 14, i.e., the surface defining foot space 48.

Panels 38 and 40 and lining layer 46 may be formed from a variety of materials (e.g., textiles, fabrics, polymer foam, leather, synthetics) that can be stitched, bonded or embroidered together. As an example, heel panel 40 can be formed of a smooth material, such as leather or a synthetic material, while toe panel 38 can be formed of a breathable material, such as a mesh, woven or knitted material. In many conventional shoes, panels of starkly contrasting materials adjoin at edges that form distinct lines. Those lines can be covered with various foxing, striping, piping or webbing, but those items themselves can leave sharply visible edge lines and add potentially undesirable thickness and stiffness to the shoe.

Embroidery area 12A can be configured to provide a comfortable, aesthetically pleasing joint between toe panel 38 and heel panel 40. Embroidery area 12A can include threads 56A and 58A, which can extend from the exterior E of upper 14, as shown in FIG. 1, to the interior I of upper 14 in foot space 48. Threads 56A and 58A loop back and forth between interior I and exterior E of upper 14 to interlock each of toe panel 38 and heel panel 40 with each other.

Figure 3:
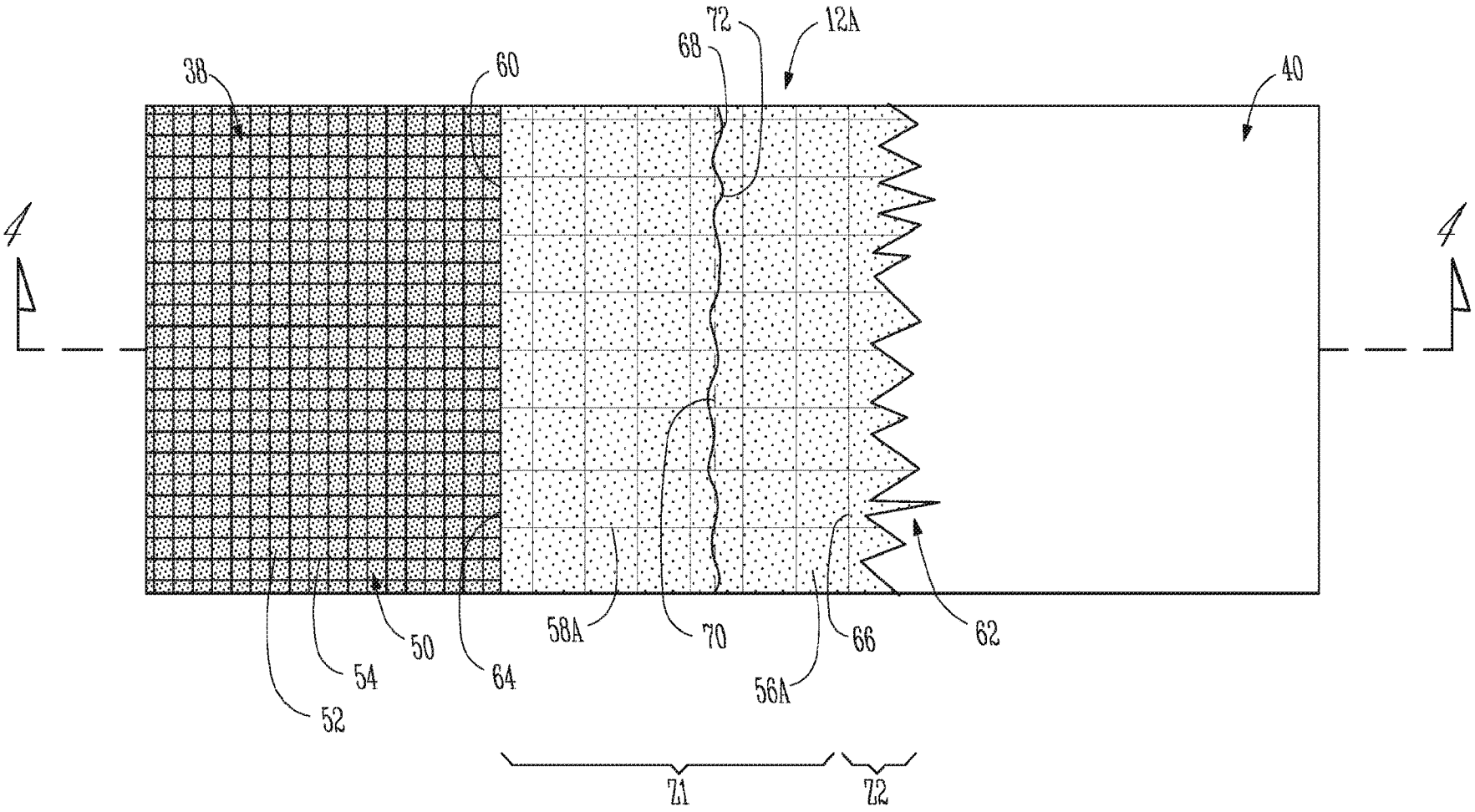
FIG. 3 is a schematic view of a first panel and a second panel of an upper for an article of footwear joined by an embroidery stitch.

FIG. 3 is a schematic view of toe panel 38 and heel panel 40 of upper 14 for article of footwear 10 joined by embroidery area 12A. Embroidery area 12A comprises threads 56A and 58A that extend through toe panel 38 and heel panel 40 to interlock the panels of upper 14 to each other. Toe panel 38 can include texturing that produces low portions 50 and high portions 52. Threads 56A and 58A of embroidery area 12A can be laid out or patterned to replicate or mimic the texturing of low portions 50 and high portions 52. Threads 56A can extend from first edge 60 to second edge 62, and threads 58A can extend from first edge 64 to second edge 66.

Figure 4:
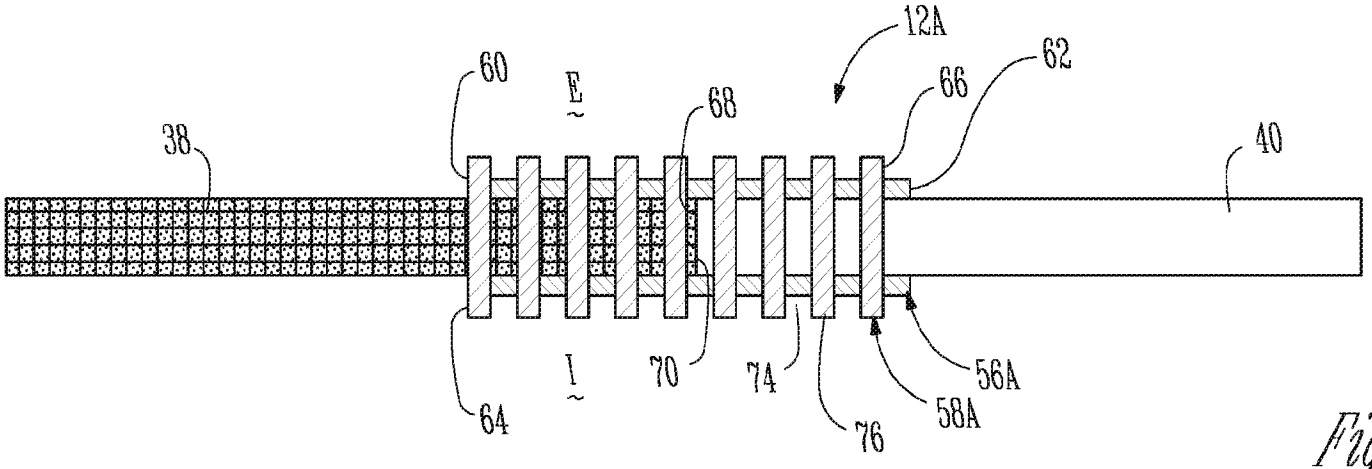
FIG. 4 is a cross-sectional view of the embroidery stitch of FIG. 3 showing an embodiment where two different embroidery patterns are provided to produce an aesthetically appealing mechanical joint that simulates a texture and appearance of one of the first and second panels.

In the example of FIG. 3, toe panel 38 and heel panel 40 are positioned in an abutting relationship such that posterior edge 68 of toe panel 38 abuts anterior edge 70 of heel panel 40, as can additionally be seen in FIG. 4. Posterior edge 68 and anterior edge 70 can be joined by stitch 72. Stitch 72 comprises an initial connection between toe panel 38 and heel panel 40 that provides immobilization between the two panels in order to allow the embroidery process to take place. In other examples, stitch 72 is omitted. Stitch 72 may comprise a single strand or fiber having a zigzag shape. In yet other examples, a stitch having a different shape or different number of strands can be used. For example, a smoothly curved stitch or a two- or three-strand stitch may be used. However, the fastening provided by stitch 72, or its alternatives, need not provide the main securing force between panels 38 and 40 as that can be provided by embroidery area 12A.

Embroidery area 12A simultaneously provides mechanical coupling between panels 38 and 40 and a customizable, aesthetically variable appearance on upper 14. In the example of FIG. 3, embroidery area 12A comprises threads 56A and 58A that simulate different aspects of toe panel 38. Threads 56A can be patterned to mimic low regions 52 of toe panel 38 and threads 58A can be patterned to mimic high regions 54 of toe panel 38. Thus, embroidery area 12A can provide a transition between panel 38 and panel 40 that softens the hard edge formed at the juncture of posterior edge 68 and anterior edge 70. Embroidery area 12A can also be used to provide an aesthetically pleasing transition between toe panel 38 and heel panel 40. For example, threads 58A can stop short of the edge of threads 56A at irregular edge 66, and threads 56A can continue into heel panel 40 to form irregular edge 62. As such, embroidery area 12A can appear to simulate a fading or tattering of heel panel 40 into toe panel 38.

FIG. 4 is a cross-sectional view of embroidery area 12A of FIG. 3 showing an embodiment where threads 56A and 58A are positioned between an interior I and an exterior E of toe panel 38 and heel panel 40. Strands 74 of thread 56A are schematically shown extending between exterior E and interior I of upper 14. Likewise, strands 76 are schematically shown extending between exterior E and interior I of upper 14. Strands 74 and 76 represent a plurality of threads or strings making up each of treads 56A and 58A, respectively. Strands 74 and 76 can be laid down using any conventional embroidering process. The dimensions, e.g. thicknesses, of panels 38 and 40 and strands 74 and 76 are, unless otherwise specified, not drawn to scale and are exaggerated for illustrative purposes.

In the example shown, threads 56A are positioned directly against major surfaces of toe panel 38 and heel panel 40, extending across edges 68 and 70. Strands 74 of threads 56A extend through toe panel 38 and heel panel 40 (although this is not shown in FIG. 4 so panels 38 and 40 can be visualized within the strands). Strands 74 provide a first, shallow layer of embroidery that does not protrude far from the surfaces of panels 38 and 40. Thus, strands 74 do not substantially thicken upper 14 to help produce a more comfortable fit. Strands 74 can substantially continuously cover the surfaces of panels 38 and 40 to provide a high level of mechanical interlocking between panels 38 and 40, as well as providing a first texture to embroidery area 12A. For example, strands 74 can have the same color as low portions 52 of toe panel 38 so as to extend the color of toe panel 38 into heel panel 40. Strands 74 can form a base surface for embroidery area 12A.

In the example shown, threads 58A are positioned directly against threads 56A along the major surfaces of toe panel 38 and heel panel 40, also extending across edges 68 and 70. Strands 76 of threads 58A extend through threads 56A, panel 38 and panel 40. Strands 76 provide a second, shallow layer of embroidery that does not protrude far from the surfaces of threads 56A. Thus, strands 76 do not substantially thicken upper 14 to help produce a more comfortable fit. Strands 76 can only partially or intermittently cover the surfaces of threads 56A to provide a three-dimensional texture to provide a second level of mechanical interface, as well as providing a second texture to embroidery area 12A. For example, strands 76 can have the same color as high portions 54, which can be different than the color of low portions 52, of toe panel 40 so as to appear to extend the texture of toe panel 38 into heel panel 40. Strands 76 can form a plurality of ridges or ribs along the base surface of strands 74. The ridges or ribs can be formed in a regular pattern, such as the grid pattern depicted in FIG. 3.

Strands 74 and 76 extend beyond an exterior E of toe panel 38 and heel panel 40 in order to provide a visual and tangible finish to panels 38 and 40. In particular, strands 74 and 76 produce a three-dimensional contour that simulates texture 50 of toe panel 38. Strands 74 and 76 can be fabricated from any material suitable for embroidering, such as cotton, nylon, polyester or the like.

In various examples, embroidery area 12A can be configured to have a higher density of strands 74 and 76 in toe panel 38 as compared to the density of strands 74 and 76 in heel panel 40. Thus, in zone Z1 (better seen in FIG. 3), which can extend along toe panel 38, across ends 68 and 70 and into heel panel 40, strands 74 can be uniformly or regularly distributed over panels 38 and 40. Likewise, in zone Z1, strands 76 can be uniformly or regularly distributed over panels 38 and 40. Thus, zone Z1 not only provides a pattern that simulates texture 50 of toe panel 38, but also provides a high level of mechanical interlocking, particularly as compared to zone Z2.

In zone Z2, which can extend only in heel panel 40, the appearance of strands 74 and 76 can become non-uniform or irregular. The density of strands 74 and 76 can trail off in heel panel 40 because substantial mechanical interlocking has already been provided in zone Z1. Strands 74 and 76 can be configured to visually, from a color and texture standpoint, resemble toe panel 38 becoming thinner and tattered, and ultimately disintegrating at a terminal edge. For example, the ribs or ridges formed strands 76 can become only partially formed. Each of strans 74 and 76 can form a plurality of peaks and valleys along edges 62 and 66 to form irregular shapes. Thus, in the example of FIGS. 3 and 4, embroidery area 12A simulates a transition resembling a gradual blending or bleeding of panels 38 and 40 into each other. In other examples, embroidery area 12A can follow other fading patterns and transitions.

As mentioned above, the materials, texture and color for toe panel 38 and heel panel 40 can vary so as to provide different aesthetic effects. In one example, toe panel 38 may formed of a smooth, non-woven material such as a leather product, (e.g. natural or synthetic leather), while heel panel 40 is formed of a rough, textile material such as fabric. In one example, panels 38 and 40 can have the same color, and embroidery area 12A can provide a transition in texture. In another example, panels 38 and 40 can be of the same texture with different colors, and embroidery area 12A can provide a transition in color.

Figure 5:
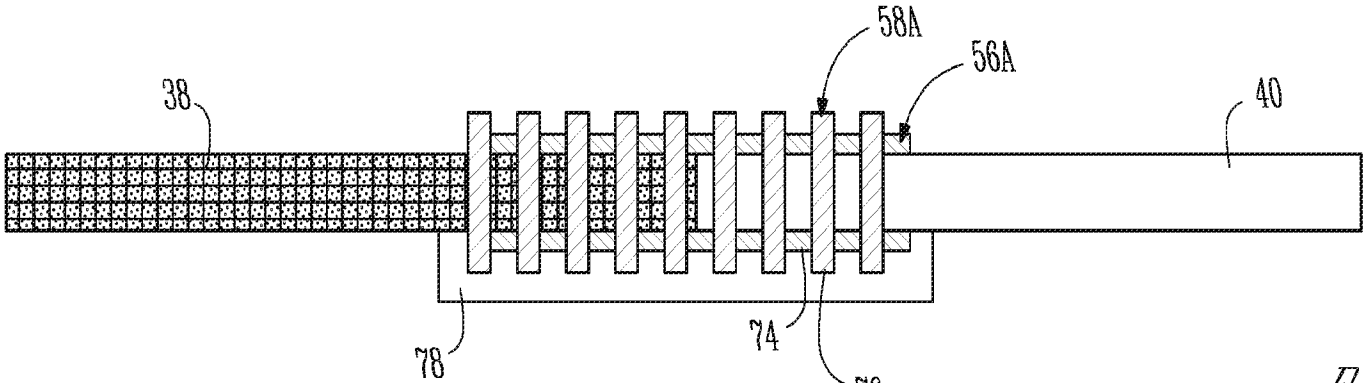
FIG. 5 is a cross-sectional view of the embroidery stitch of FIG. 3 showing an embodiment having an adhesive layer positioned over the embroidery stitch within the footwear upper.

FIG. 5 is a cross-sectional view of embroidery area 12A of FIG. 3 showing an embodiment having adhesive layer 78 positioned along interior I of embroidery area 12A. Embroidery area 12A of FIG. 5 is configured similarly as that of FIG. 4 except adhesive layer 78 is provided to form an initial bond between toe panel 38 and heel panel 40. Adhesive layer 78 can be used in addition to or alternatively to stitch 72. Adhesive layer 78 can facilitate the embroidery process by, for example, facilitating the pushing of strands 74 and 76 through panels 38 and 40 in a uniform manner during the embroidery process. That is, adhesive layer 78 can prevent wrinkling or bunching of panels 38 and 40 to facilitate proper orientation, alignment and insertion of needles used in the embroidery process. Any suitable adhesive may be used. For example, hot melt adhesive such as ethylene-vinyl acetate (EVA) copolymers may be used. In other examples, solvent based adhesives or polymer dispersion adhesives may be used. In one example, adhesive layer 78 can be applied after stitch 72 is formed, followed by formation of threads 56A and 58A over the adhesive layer. In various examples, placement and insertion of threads 56A and 58A can occur after the adhesive layer is set, e.g. dried or hardened. In other examples, an adhesive layer can be applied over strands 74 and 76 on the inside of panels 38 and 40 within interior I of upper 14 after the embroidery process to immobilize the joint.

Figure 6:
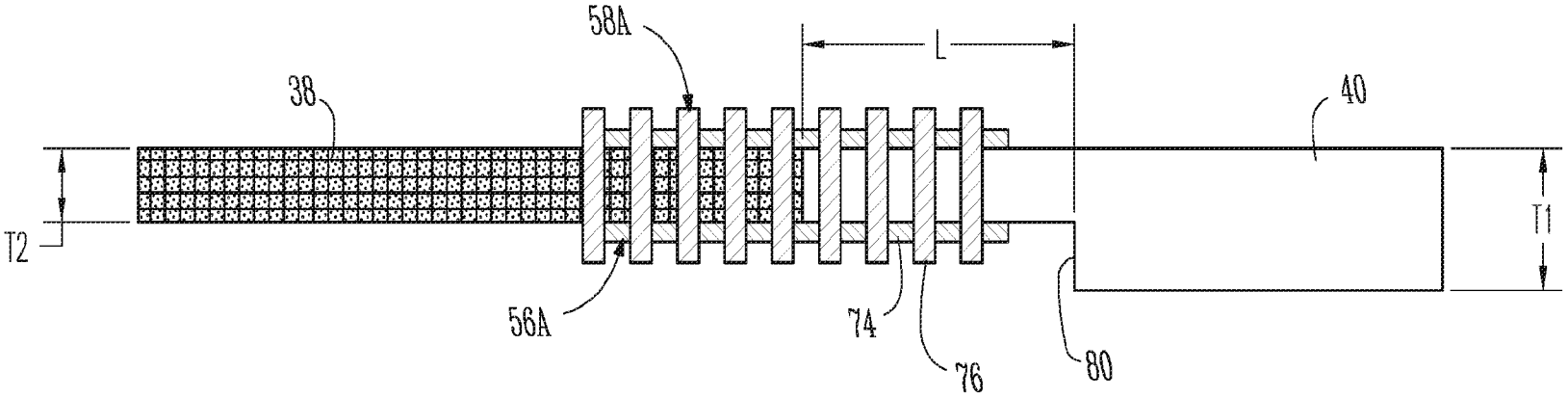
FIG. 6 is a cross-sectional view of the embroidery stitch of FIG. 3 showing an embodiment in which the first panel includes skiving to reduce its thickness at the embroidery stitch.

FIG. 6 is a cross-sectional view of embroidery area 12A of FIG. 3 showing an embodiment in which heel panel 40 includes skiving 80 to reduce its thickness at embroidery area 12A. Embroidery area 12A of FIG. 6 is configured similarly as that of FIG. 4 except skiving 80 is provided on heel panel 40 to facilitate strands 74 and 76 of threads 56A and 58A passing through heel panel 40. Skiving 80 can extend along length L to reduce initial thickness T1 of heel panel 40 along embroidery area 12A. Skiving length L can also be selected to extend beyond the length of embroidery area 12A. For example, skiving 80 can extend further to the right in FIG. 6 than does embroidery area 12A. Skiving 80 can reduce initial thickness T1 to reduced thickness T2 along at least the length heel panel 40 engages embroidery area 12A. Thickness T2 can be selected to match the thickness of toe panel 38. In another example, thickness T2 can be selected based on the embroidery process, such as the length of embroidery needles. Stitch 72 and adhesive layer 78 can be used in combination with skiving 80. Skiving 80 can be provided on heel panel 40 before the embroidery process occurs, but after heel panel 40 is cut to the shape desired or needed for the fabrication of upper 14.

Figure 7:
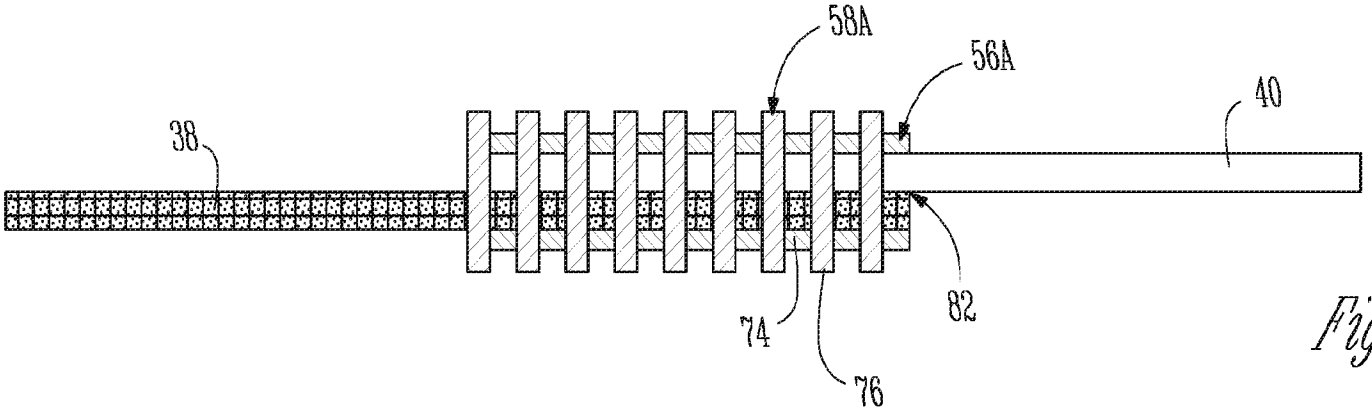
FIG. 7 is a cross-sectional view of the embroidery stitch of FIG. 3 showing an embodiment where the first and second panels overlap with each other.

FIG. 7 is a cross-sectional view of embroidery area 12A of FIG. 3 showing an embodiment where toe panel 38 and heel panel 40 overlap with each other along overlap 82. Embroidery area 12A of FIG. 7 is configured similarly as that of FIG. 4 except overlap 82 is provided between toe panel 38 and heel panel 40 to facilitate strands 74 and 76 of threads 56A and 58A passing therethrough and to facilitate construction of embroidery area 12A. In some examples, particularly those where one or both of toe panel 38 and heel panel 40 are thin relative to, for example, the length of embroidery needles used to produce embroidery area 12A, toe panel 38 and heel panel 40 can be overlapped to facilitate fabrication of embroidery area 12A. For example, it can be easier to provide stitch 72 and adhesive layer 78, while panels 38 and 40 are overlapped rather than abutted. Overlap 82 can extend fully across embroidery area 12A as shown in FIG. 7 in order to allow maximum mechanical interlocking. In other examples, overlap 82 can extend a partial length of embroidery area 12A, which can be used to manipulate the texture or appearance of embroidery area 12A. For example, an irregularly shaped edge of toe panel 38 can be overlapped on top of heel panel 38 to provide another degree of variability in the texture and appearance of embroidery area 12A.

Figure 8:
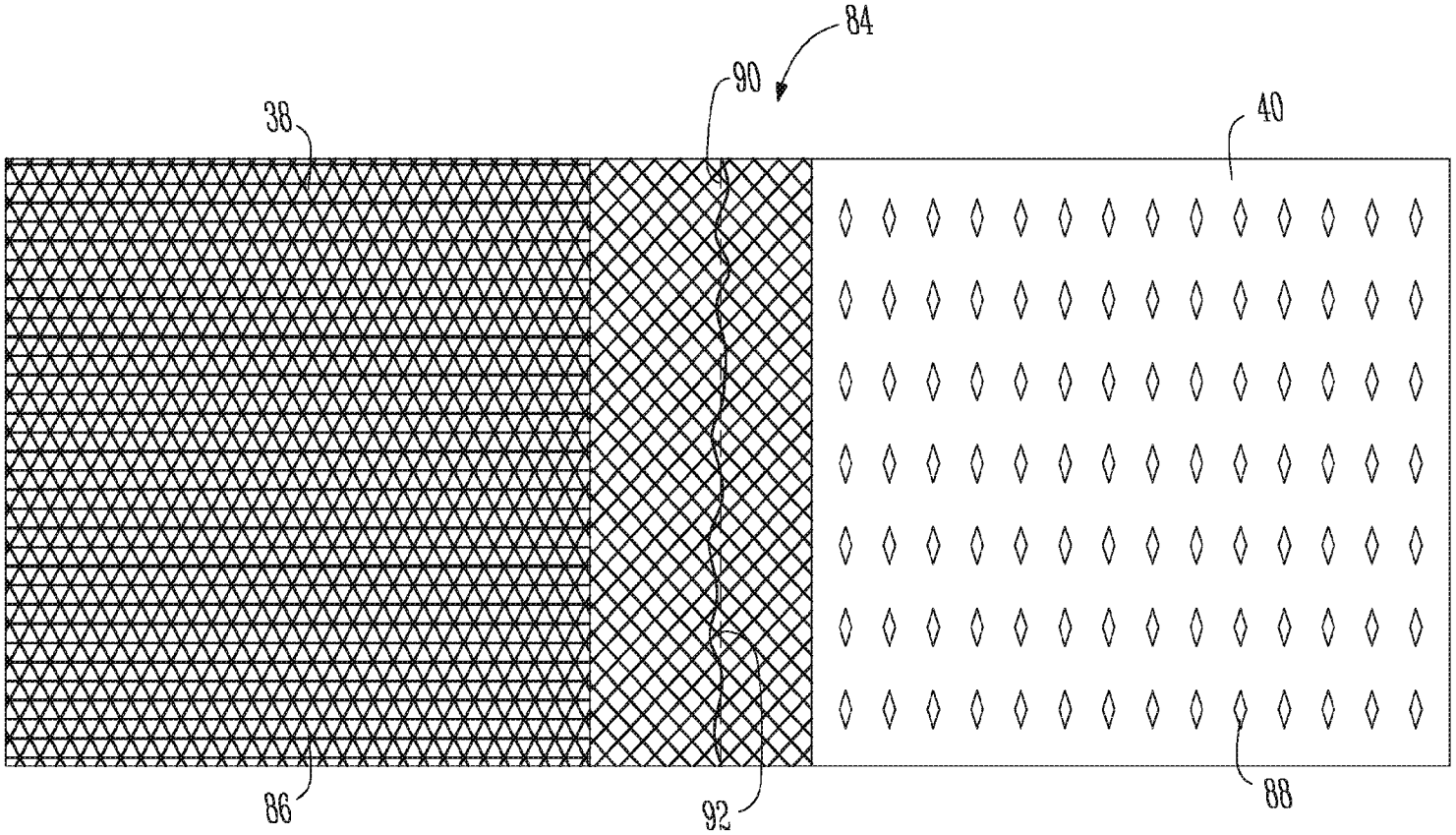
FIG. 8 is a front schematic view of a first panel and a second panel of an upper for an article of footwear joined by an embroidery stitch wherein the embroidery simulates surface features on both the first and second panels.

FIG. 8 is a front schematic view of toe panel 38 and heel panel 40 of upper 14 for article of footwear 10 joined by embroidery 84 wherein embroidery 84 simulates surface features 86 and 88 on each of toe panel 38 and heel panel 40. Toe panel 38 can include decorative surface features 86, such as an embossed or printed pattern of shapes. Likewise, heel panel 40 can include decorative surface features 88, such as an embossed or printed pattern of shapes. In one example, surface features 86 and 88, comprise geometric shapes, such as diamonds, squares or circles. Embroidery 84 can be provided to join toe panel 38 and heel panel 40 using a stitch pattern that replicates surface features 86 and 88. Embroidery 84 can comprise a single layer of embroidered threads, or can comprise a plurality of layers of embroidered threads. In one particular example, heel panel 40 comprises a synthetic polymer material having surface features 88 comprising an embossed diamond pattern, toe panel 38 comprises a synthetic neoprene material having surface features 86 comprising a printed diamond pattern, and embroidery 84 comprises a single layer of an embroidered diamond pattern formed on overlapping portions of toe panel 38 and heel panel 40 to join the panels together. Edge 90 of toe panel 38 can be located so as to not intersect any of surface features 86, and edge 92 of heel panel 40 can be located so as to not intersect any of surface features 88. Embroidery 84 can produce only fully formed shapes matching those of surface features 86 and 88. As such, the whole of the upper of the footwear does not include any aesthetically unappealing variations that are easily perceptible.

VARIOUS NOTES & EXAMPLES

Example 1 can include or use subject matter such as an article of footwear comprising a sole structure, and an upper connected to the sole structure to form an enclosure to at least partially receive a foot, the upper comprising a first panel forming a first portion of the upper and having a first texture, a second panel forming a second portion of the upper and having a second texture, and an embroidery area extending across portions of the first panel and the second panel and having an appearance that replicates the first texture extending into the second texture.

Example 2 can include, or can optionally be combined with the subject matter of Example 1, to optionally include the first panel and the second panel being structurally joined by threads of embroidery included in the embroidery area.

Example 3 can include, or can optionally be combined with the subject matter of one or any combination of Examples 1 or 2 to optionally include an embroidery area that has an irregular edge along the second panel.

Example 4 can include, or can optionally be combined with the subject matter of one or any combination of Examples 1-3 to optionally include an embroidery area that has a uniform edge along the first panel.

Example 5 can include, or can optionally be combined with the subject matter of one or any combination of Examples 1-4 to optionally include an embroidery area that simulates a tattering of the first panel into the second panel.

Example 6 can include, or can optionally be combined with the subject matter of one or any combination of Examples 3-5 to optionally include a uniform edge that is linear and an irregular edge that has a plurality of peaks and valleys.

Example 7 can include, or can optionally be combined with the subject matter of one or any combination of Examples 1-6 to optionally include a first panel that comprises a first material having a first roughness and a second panel that comprises a second material having a second roughness less than the first roughness.

Example 8 can include, or can optionally be combined with the subject matter of one or any combination of Examples 1-7 to optionally include a first material that is a textile and a second material that is a non-woven material.

Example 9 can include, or can optionally be combined with the subject matter of one or any combination of Examples 1-8 to optionally include a first material that is a fabric and a second material that is a leather product.

Example 10 can include, or can optionally be combined with the subject matter of one or any combination of Examples 1-9 to optionally include a first panel that includes a matrix of features disposed on a surface of the first panel and an embroidery area that replicates those features on the second panel.

Example 11 can include, or can optionally be combined with the subject matter of one or any combination of Examples 1-10 to optionally include an embroidery area that includes a first pattern replicating a surface and a second pattern replicating a matrix of features.

Example 12 can include, or can optionally be combined with the subject matter of one or any combination of Examples 1-11 to optionally include a first pattern that is a first color and a second pattern that is a second color different from the first.

Example 13 can include, or can optionally be combined with the subject matter of one or any combination of Examples 1-12 to optionally include first and second panels that are abutted along edges of the respective first and second panels.

Example 14 can include, or can optionally be combined with the subject matter of one or any combination of Examples 1-12 to optionally include first and second panels that overlap along edges of the respective first and second panels.

Example 15 can include, or can optionally be combined with the subject matter of one or any combination of Examples 1-14 to optionally include a lining layer extending along the embroidery area along an interior of the upper.

Example 16 can include, or can optionally be combined with the subject matter of one or any combination of Examples 1-5 to optionally include a stitch joining the first and second panels.

Example 17 can include, or can optionally be combined with the subject matter of one or any combination of Examples 1-16 to optionally include an adhesive layer disposed between the first and second panels.

Example 18 can include, or can optionally be combined with the subject matter of one or any combination of Examples 1-17 to optionally include an embroidery area that is located along a lateral side of the upper posterior of the MTP joint.

Example 19 can include or use subject matter such as an upper for an article of footwear, the upper comprising a first panel of a first material; a second panel of a second material, and an embroidery area joining the first and second panel, the embroidery area having an appearance simulating the first material extending into the second material.

Example 20 can include, or can optionally be combined with the subject matter of Example 19, to optionally include an embroidery area that simulates a texture of the first material.

Example 21 can include, or can optionally be combined with the subject matter of one or any combination of Examples 19 or 20, to optionally include an embroidery area that extends into the first panel disproportionately relative to the second panel.

Example 22 can include, or can optionally be combined with the subject matter of one or any combination of Examples 19-21 to optionally include an embroidery area that extends into the first panel over a greater surface area than the second panel.

Example 23 can include, or can optionally be combined with the subject matter of one or any combination of Examples 19-22 to optionally include an embroidery area that extends along the first panel at a uniformly linear edge and along the second panel along an irregular edge having a plurality of peaks and valleys.

Example 24 can include, or can optionally be combined with the subject matter of one or any combination of Examples 19-23 to optionally include a stitch joining the first and second panels, and an adhesive disposed along the embroidery along an interior of the upper.

Example 25 can include, or can optionally be combined with the subject matter of one or any combination of Examples 19-24 to optionally include first and second panels that are abutted at edges of each panel.

Example 26 can include, or can optionally be combined with the subject matter of one or any combination of Examples 19-25 to optionally include first and second panels that form at least part of an enclosure for receiving a foot, wherein the embroidery is located anterior of an MTP joint of the foot on a vamp of the upper.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A method of manufacturing an upper for an article of footwear, the method comprising:

positioning a first panel adjacent a second panel at an interface;

applying an adhesive against the first panel and the second panel along before embroidering the first and second patterns the interface:

embroidering the first panel and the second panel across the interface with a first pattern; and embroidering the first panel and the second panel across the interface with a second pattern;

wherein the first pattern and the second pattern are different.

2. The method of claim 1, wherein:

the first pattern extends along a first edge on a first side of the interface and the second pattern extends along a second edge along a second side of the interface;

the first edge is straight; and the second edge is jagged.

3. The method of claim 1, wherein positioning the first panel adjacent the second panel at the interface comprises abutting an edge of the first panel against an edge of the second panel.

4. The method of claim 1, wherein positioning the first panel adjacent the second panel at the interface comprises overlapping the first panel and the second panel.

5. The method of claim 1, further comprising:

holding the first panel and second panel in position relative to each other by placing a zigzag stitch back-and-forth across the interface before embroidering the first and second patterns; and structurally joining the first panel and the second panel to each other with the embroidery of the first pattern and the embroidery of the second pattern.

6. The method of claim 1, further comprising skiving one of the first panel and the second panel before embroidering the first and second patterns.

7. The method of claim 1, wherein the first pattern has a first pattern of discrete shapes and the second pattern has a second pattern of discrete shapes, wherein the first discrete shapes are different than the second discrete shapes.

8. The method of claim 1, wherein the first pattern has a first embroidery height and the second pattern has a second embroidery height, wherein the first embroidery height is different than the second embroidery height.

9. The method of claim 1, wherein:

the first panel has a first texture and the second panel has a second texture different than the first texture; and the first pattern of the first embroidery mimics the first texture and the second pattern of the second embroidery mimics the second texture.

10. A method of manufacturing an upper for an article of footwear, the method comprising:

forming a first panel having a first upper surface with a first texture into a first portion of the upper;

forming a second panel having a second upper surface with a second texture into a second portion of the upper;

positioning the first panel and the second panel together along an interface; and joining the first panel and the second panel with an embroidery area spanning the interface;

wherein a density of stitching of the embroidery area is higher in the first panel than in the second panel.

11. The method of claim 10, further comprising forming the embroidery area to have an irregular edge along the second panel.

12. The method of claim 11, further comprising forming the embroidery area to have an appearance that replicates the first texture bleeding into the second texture.

13. The method of claim 12, wherein the first panel comprises a textile material and the second panel comprises a non-woven material.

14. The method of claim 10, further comprising forming the embroidery area to extend into the first panel disproportionately relative to the second panel.

15. The method of claim 14, wherein the embroidery area extends along the first panel at a uniformly linear edge and along the second panel along an irregular edge having a plurality of peaks and valleys.

16. The method of claim 10, wherein:

the first portion of the upper and the second portion of the upper come together to form at least part of an enclosure for receiving a foot; and wherein the embroidery area is adapted to be located anterior of a metatarsophalangeal joint (MTP) joint of the foot on a vamp of the upper.

17. The method of claim 10, wherein the first panel and the second panel are positioned to abut each other, further comprising placing a zigzag stitch back-and-forth across the interface before producing the embroidery area.

18. The method of claim 10, wherein the first panel and the second panel are positioned to overlap each other, further comprising applying an adhesive between the first panel and the second panel along the interface before producing the embroidery area.

19. A method of manufacturing an upper for an article of footwear, the method comprising:

positioning a first panel adjacent a second panel at an interface;

embroidering the first panel and the second panel across the interface with a first pattern; and embroidering the first panel and the second panel across the interface with a second pattern;

wherein the first pattern and the second pattern are different such that:

the first pattern extends along a first edge on a first side of the interface and the second pattern extends along a second edge along a second side of the interface;

the first edge is straight; and the second edge is jagged.

20. A method of manufacturing an upper for an article of footwear, the method comprising:

positioning a first panel adjacent a second panel at an interface;

holding the first panel and second panel in position relative to each other by placing a zigzag stitch back-and-forth across the interface;

embroidering the first panel and the second panel across the interface with a first pattern;

embroidering the first panel and the second panel across the interface with a second pattern; and structurally joining the first panel and the second panel to each other with the embroidery of the first pattern and the embroidery of the second pattern;

wherein the first pattern and the second pattern are different.

* * * * *